US008870551B2

(12) United States Patent
Chuang

(10) Patent No.: US 8,870,551 B2
(45) Date of Patent: Oct. 28, 2014

(54) PUMP ADAPTED TO BE OPERABLY MOVED OR TO USE HIGH-PRESSURE AIR CARTRIDGE TO INFLATE OBJECT

(76) Inventor: Louis Chuang, Taichung (TW)

( * ) Notice: Subject to any disclaimer, the term of this patent is extended or adjusted under 35 U.S.C. 154(b) by 525 days.

(21) Appl. No.: 13/304,760

(22) Filed: Nov. 28, 2011

(65) Prior Publication Data

US 2013/0136625 A1 May 30, 2013

(51) Int. Cl.

| | |
|---|---|
| ***F04B 53/10*** | (2006.01) |
| ***F04B 39/12*** | (2006.01) |
| ***F04B 33/00*** | (2006.01) |

(52) U.S. Cl.

USPC ..... 417/374; 417/467; 417/469; 141/54

(58) Field of Classification Search

USPC ..... 417/234, 374, 553, 570, 442, 489, 467, 417/469; 137/318; 141/38, 247, 248, 489, 141/104, 105, 329, 339

See application file for complete search history.

(56) References Cited

U.S. PATENT DOCUMENTS

| | | | | |
|---|---|---|---|---|
| 6,164,938 | A * | 12/2000 | Chuang | 417/569 |
| 6,202,714 | B1 * | 3/2001 | Wang | 141/329 |
| 6,883,565 | B2 * | 4/2005 | Marui | 141/18 |
| 6,953,326 | B2 * | 10/2005 | Wang | 417/234 |
| 8,414,277 | B1 * | 4/2013 | Hollars | 417/570 |
| 2012/0192993 | A1 * | 8/2012 | Chuang | 141/351 |

* cited by examiner

*Primary Examiner* — Nathan Zollinger

(74) *Attorney, Agent, or Firm* — Alan Kamrath; Kamrath IP Lawfirm, P.A.

(57) ABSTRACT

A pump which is adapted to be operably moved or to use a high-pressure air cartridge to inflate an object includes a cylinder assembly, a first nozzle head assembly, and a second nozzle head assembly. The pump that is operably moved will induce external air in a chamber defined in the cylinder assembly. The first nozzle head assembly is engagable with the air cartridge and the object and allows high-pressure air in the air cartridge to flow into the object. The first nozzle head assembly is not in fluidal communication with the chamber. The second nozzle head assembly is engagable with the object and allows the air in the chamber to flow into the object by operably moving the pump.

9 Claims, 9 Drawing Sheets

PUMP ADAPTED TO BE OPERABLY MOVED OR TO USE HIGH-PRESSURE AIR CARTRIDGE TO INFLATE OBJECT

BACKGROUND OF THE INVENTION

1. Field of the Invention

The present invention relates to a pump and, particularly to, a pump which is adapted to be operably moved or to use a high-pressure air cartridge to inflate an object.

2. Description of the Related Art

FIGS. 7 to 9 show a conventional pump 90 and an air cartridge 80. The pump 90 defines first and second ends 91 and 92 including a pump head and a pumping assembly respectively. The pump 90 includes a tube 93, a plunger 94, and a nozzle 95. The plunger 94 is reciprocally moved for pumping air into an object connected to the pump 90. The nozzle 95 is disposed in the pump head. The object to be inflated is engaged with the nozzle 95. The nozzle 95 includes a chamber having an opening through which the object to be inflated is inserted. Further, first and second orifices 96 and 98 are defined in the first and second ends 91 and 92 of the pump 90 respectively. Further, a valve stem 97 is extended in the first orifice 96. When the air cartridge 80 is used with the pump 90 in order to inflate an object rapidly, an outlet 81 of the air cartridge 80 is inserted in the first orifice 96 and the valve stem 97 can cause a closure 84 of the air cartridge 80 to open, thereby allowing high-pressure air in a reservoir 83 of the air cartridge 80 to flow into the pump head and the nozzle 95 and into the object. The first orifice 96 includes an inner thread and the outlet 81 includes an outer thread 82 engaged therewith. A problem is found that the aforementioned parts disposed in the interior of the pump are liable to be damaged by the high-pressure air.

The present invention is, therefore, intended to obviate or at least alleviate the problems encountered in the prior art.

SUMMARY OF THE INVENTION

According to the present invention, a pump which is adapted to be operably moved or to use a high-pressure air cartridge to inflate an object includes a cylinder assembly, a first nozzle head assembly, and a second nozzle head assembly.

The cylinder assembly defines a chamber and includes first and second cylinders that include the chamber defined therebetween. The second cylinder is movable relative to the first cylinder linearly. The first cylinder includes a piston engaged and moved together and disposed between the first and second cylinders. The piston is operably moved to induce external air in and out of the chamber. The first cylinder defines a first proximal end and a first distal end opposite to the first proximal end and the second cylinder defining a second proximal end and a second distal end opposite to the second proximal end respectively.

The first nozzle head assembly is detachably engaged with the second distal end of the second cylinder and includes a main body, a valve stem kit, a safe device, and a joint. The main body includes inlet and outlet ends and defines a fixing end and a free end. The inlet end includes the air cartridge engagable therewith and the outlet end includes the object engagable therewith respectively. The free end of the main body includes a first space and a second space. The first space is in fluidal communication with the inlet end and the second space is in fluidal communication with the outlet end respectively. The first and second spaces include a channel extended therebetween so as to be interconnected. The valve stem kit includes a valve stem for causing a closure of the air cartridge to open and a seal ring for preventing air leak. The valve stem and the seal ring is disposed within the joint. The joint is received in the first space and adapted for causing a closure of the air cartridge to open. The safe device is disposed in the second space. The first nozzle head assembly interconnecting the air cartridge and the object allows high-pressure air in the air cartridge to flow through the first space, the channel, and the second space and includes the safe device moved to an operating position that allows the high-pressure air to flow into the object. The first and second spaces, the channel, and the inlet and outlet ends are not in fluidal communication with the chamber. The joint is used for engaging with the air cartridge. Moreover, the inlet end is defined in the joint.

The second nozzle head assembly is engaged with the first cylinder and in fluidal communication with the chamber and defining a valve-receiving end including the object engagable therewith, with the object disposed adjacent to the first proximal end of the first cylinder.

It is an objective of the present invention to provide a pump which is adapted to be operably moved or to use a high-pressure air cartridge to inflate an object.

It is another objective of the present invention to provide a pump that allows components disposed within the interior of the pump to be safeguarded from being damaged by high pressure air discharged from an air cartridge engaged with the pump.

It is another objective of the present invention that when the pump is operably moved the cartridge can be used as a grip.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
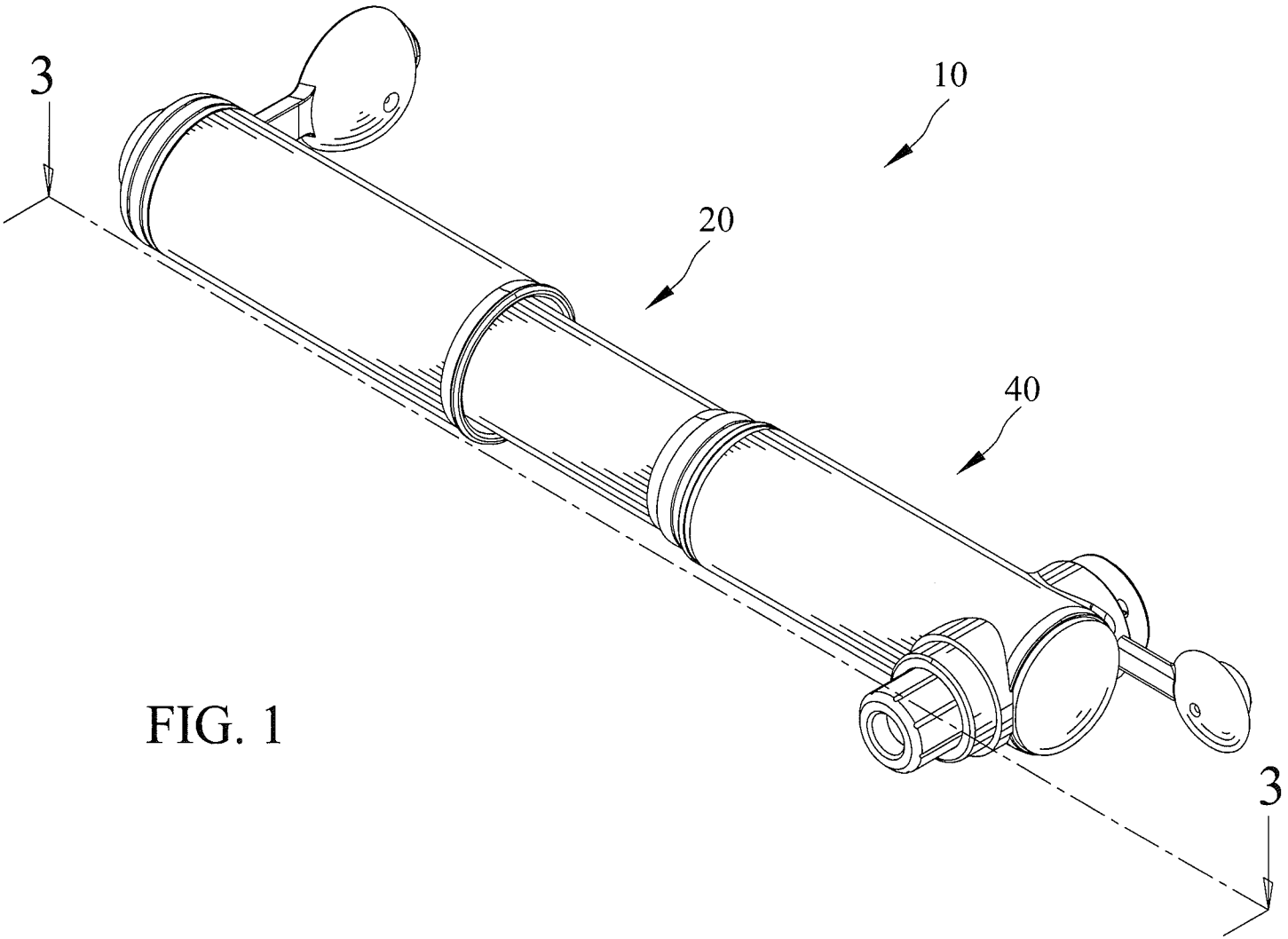
FIG. 1 is a perspective view of a pump which is adapted to be operably moved or to use a high-pressure air cartridge to inflate an object in accordance with a first embodiment of the present invention.
Figure 2:
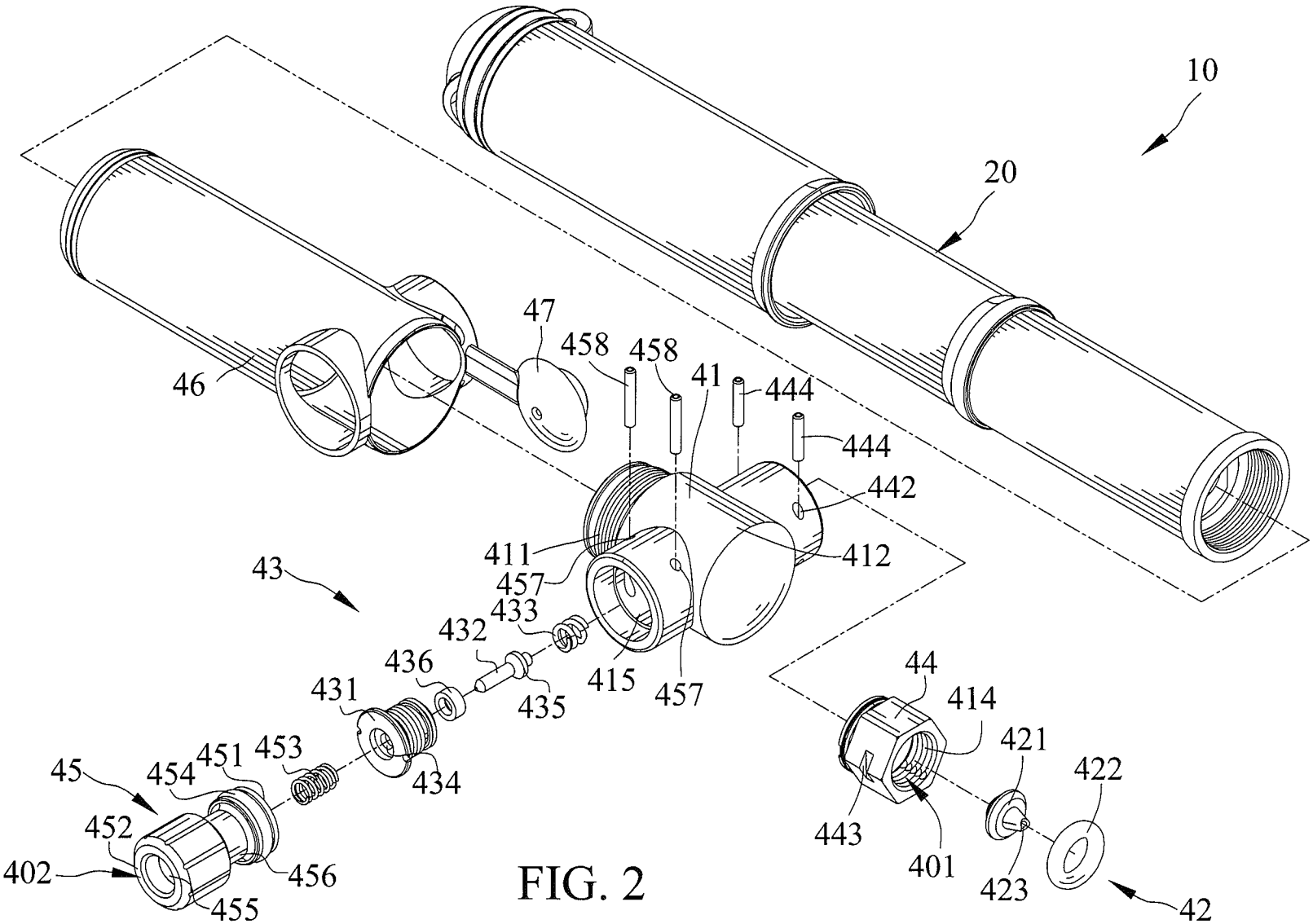
FIG. 2 is an exploded perspective view of the pump of FIG. 1.
Figure 3:
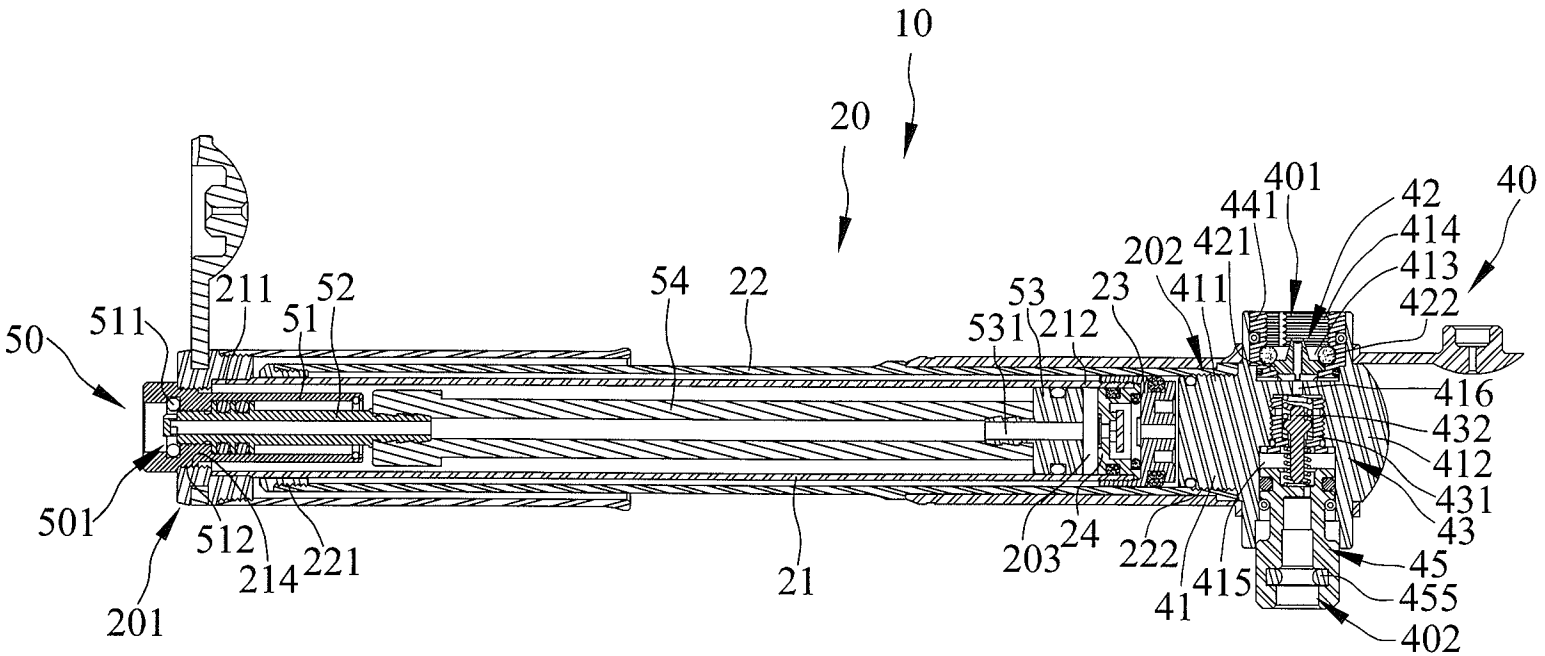
FIG. 3 is a cross-sectional view taken along line 3-3 of FIG. 1
Figure 4:
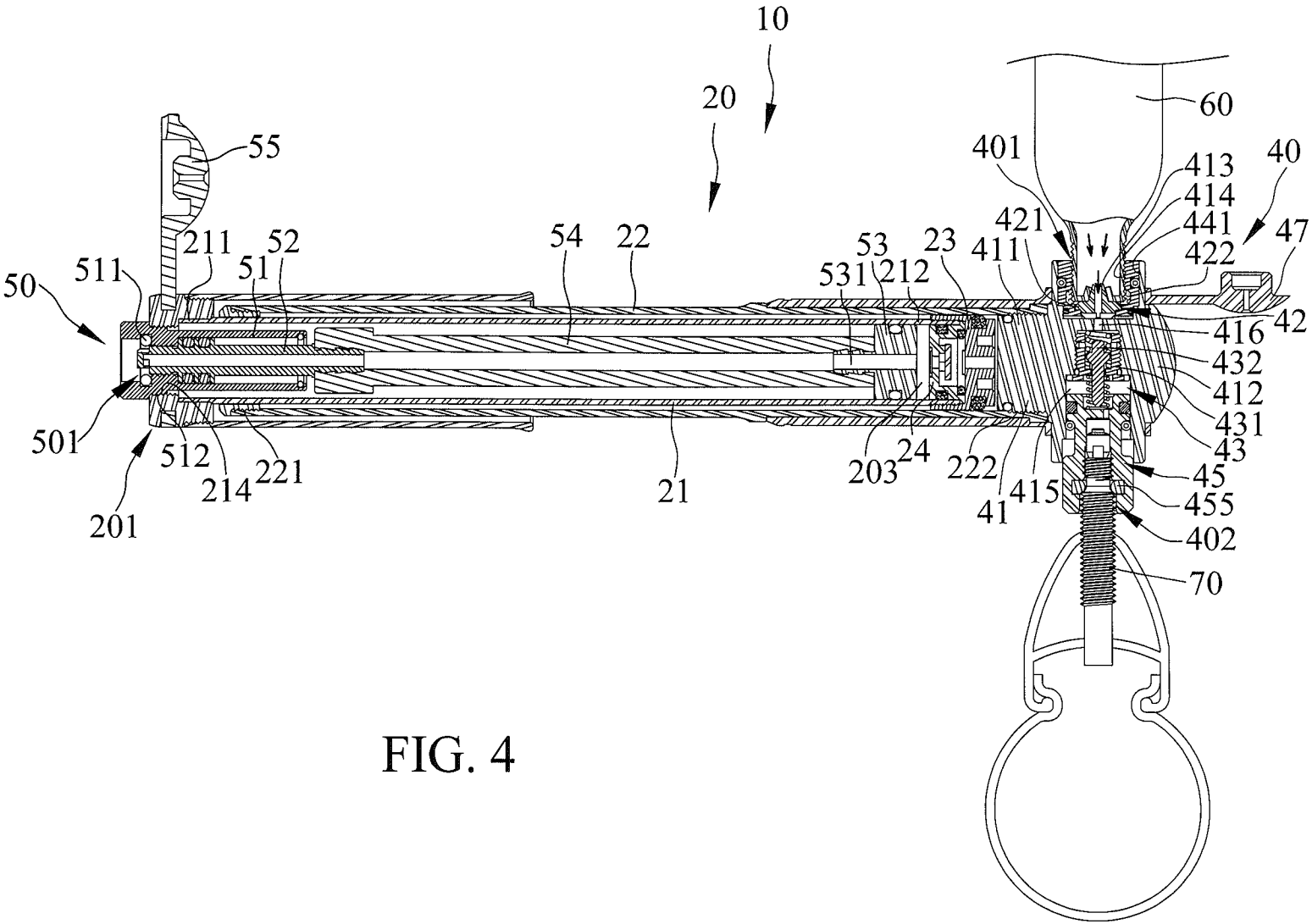
FIG. 4 illustrates the pump of FIG. 1 using a high-pressure air cartridge to inflate an object.
Figure 5:
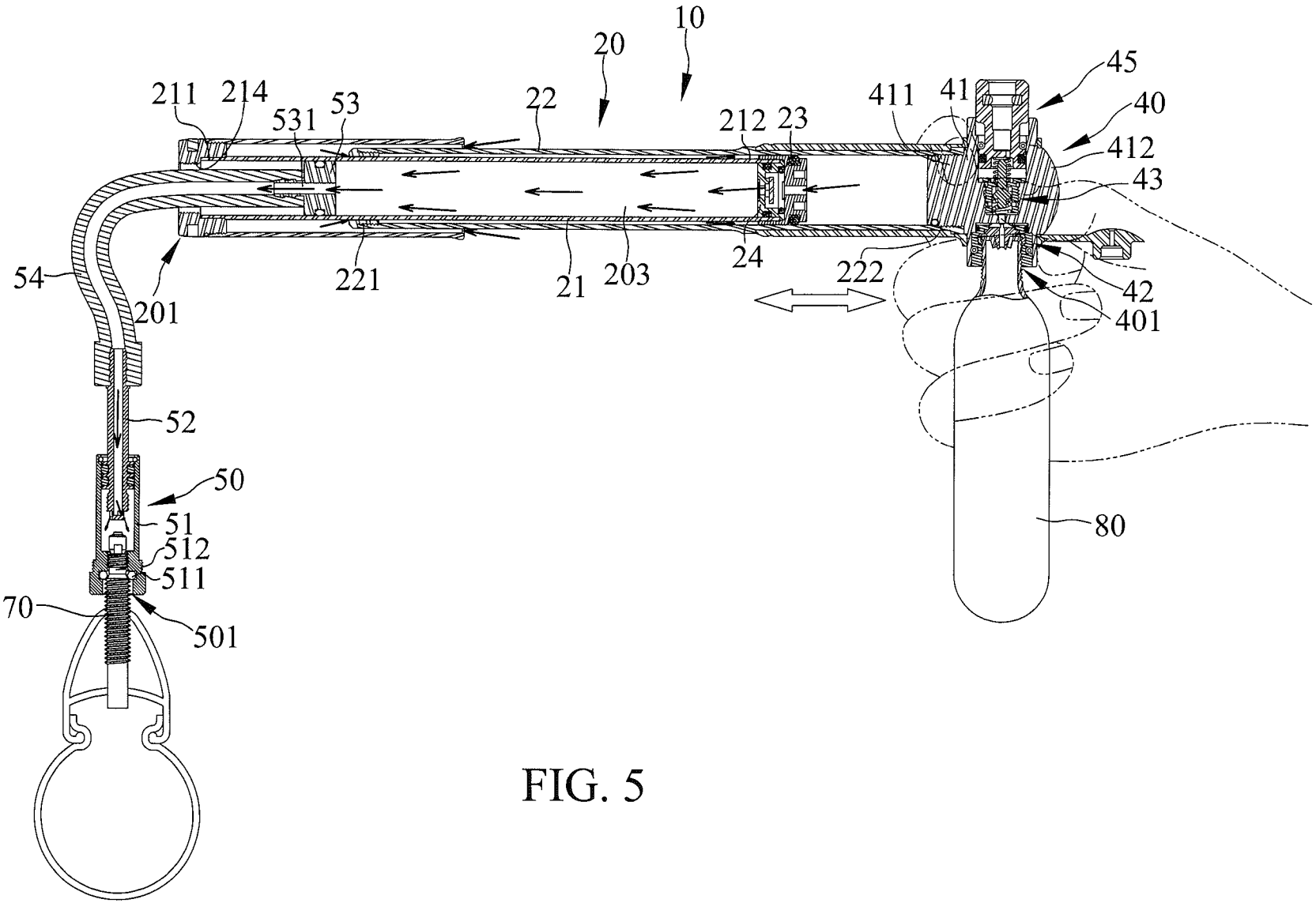
FIG. 5 is an extended view of FIG. 4 illustrating the pump of FIG. 1 operably moved to inflate the object and the air cartridge adapted to be grasped during the air-pumping operation.

FIGS. 1 through 5 show a pump 10 which is adapted to be operably moved or to use a high-pressure air cartridge 60 to inflate an object 70 in accordance with a first embodiment of the present invention includes a cylinder assembly 20, a first nozzle head assembly 40, and a second nozzle head assembly 50.

The cylinder assembly 20 defines a first end 201, a second end 202 opposite to the first end 201, and a chamber 203. The cylinder assembly 20 includes first and second cylinders 21 and 22 that include the chamber 203 defined therebetween. The second cylinder 22 is movable relative to the first cylinder 21 linearly. The first cylinder 21 includes a piston 23 engaged and moved together and disposed between the first and second cylinders 21 and 22. The piston 23 is operably moved to induce external air in and out of the chamber 203. The first cylinder 21 defines a first proximal end 211 and a first distal end 212 opposite to the first proximal end 211 and the second cylinder 22 defines a second proximal end 221 and a second distal end 222 opposite to the second proximal end 221 respectively.

The first nozzle head assembly 40 is detachably engaged with the second distal end 222 of the second cylinder 22 and includes a main body 41, a valve stem kit 42, a safe device 43, and a joint 44. The main body 41 includes inlet and outlet ends 401 and 402 and defines a fixing end 411 and a free end 412. The inlet end 401 includes the air cartridge 60 engagable therewith. The outlet end 402 includes the object 70 engagable therewith. The fixing end 411 is engaged with the second distal end 222 of the second cylinder 22. The free end 412 includes a first space 413 and a second space 415. The first space 413 includes a neck of the air cartridge 60 engagable therein. The first space 413 has an inner thread 414. The neck of the air cartridge 60 has an outer thread. The first space 413 is in fluidal communication with the inlet end 401 and the second space 415 is in fluidal communication with the outlet end 402 respectively. The first and second spaces 413 and 415 include a channel 416 extended therebetween so as to be interconnected. The valve stem kit 42 is disposed in the first space 413. The valve stem kit 42 includes a valve stem 421 for causing a closure of the air cartridge 60 to open and a seal ring 422 for preventing air leak. The valve stem 421 includes an aperture 413 extended therethrough and includes the high-pressure air adapted to flow therepass through the aperture 413. The safe device 43 is disposed in the second space 415 and includes a valve socket 431, a plunger 432, and a first biasing member 433. The valve socket 431 includes a cavity 434 extended therethrough and includes the plunger 432 and the first biasing member 433 disposed therein. The plunger 432 is biasingly engaged with the first biasing member 433 and movable relative to the valve socket 431 in a first position preventing air flowing from the first space 413 to the second space 415 and a second position allowing the air to flow from the first space 413 to the second space 415. The plunger 432 defines a sealing section 435 and the cavity 434 defines an opening respectively. The plunger 432 is moved relative to the valve socket 431 in the first position sealing section closing the opening. Further, a seal ring 436 is disposed between the valve seat 431 and the plunger 432. The joint 44 is made of metal and releasably disposed in the first space 413. The inlet end 401 is defined in the joint 44. The first nozzle head assembly 40 is adapted to be reinforced by the joint 44. The joint 44 includes an orifice 441. The orifice 441 is extended through the joint 44 and includes the valve stem kit 42 received therein and includes the air cartridge 60 engagable therewith. The joint 44 also includes an inner thread 414 formed on a periphery delimiting the orifice 441. Additionally, the first space 413 has a non-circular cross section and the joint 44 has the outer periphery having a cross section the same as that of the first space 413. The main body 41 includes a first wall delimiting the first space 413 and including at least one first hole 442 extended therethrough and transversely to the first space 413. The joint 44 has an outer periphery including at least one slot 443 inset therein. At least one fastener 444 is inserted in the at least one first hole 442 and received in the at least one slot 443 so that the joint 44 is securely restrained in the first space 413. Further, a valve receiver 45 is interacted with the safe device 43. The valve receiver 45 is releasably and movably disposed in the second space 415 and includes the object 70 engagable therewith. The valve receiver 45 is movable to a position pushing the plunger 432. The valve receiver 45 defines a first joining end 451 and a second joining end 452 opposite to the first joining end 451. The first joining end 451 is received in the second space 415 and abutted against a second biasing member 453. The second biasing member 453 is abutted against the valve socket 431 that is disposed opposite to the valve receiver 45. The outlet end 402 of the first nozzle head assembly 40 is defined in the second joining end 452. The valve receiver 45 also includes first and second seal members 454 and 455. The first seal member 454 is disposed on an outer periphery of the valve receiver 45 and abutted against a periphery of the second space 415. The second seal member 455 is disposed in a room defined in the valve receiver 45. The first nozzle head assembly 40 includes a second wall delimiting the second space 415 and including at least one second hole 457 extended therethrough and transversely to the second space and the valve receiver 45 includes at least one fixing member 458 respectively. The valve receiver 45 has an outer periphery defining a recessed section 456. The recessed section 456 is not abutted against the second wall. At least one fixing member 458 is inserted in the at least one second hole 457 and received between two distal ends of the recessed section 456 so that the joint is movably and securely restrained in the second space 415. Further, an anti-cold sheath 46 is covered on an outer periphery of the main body 41, so when high-pressure air flows from the air cartridge 60 to the object 70 through the first nozzle head assembly 40 a user thus will not feel cool. Further, a first cap 47 is utilized to selectively close a port of the inlet end 401.

The first nozzle head assembly 40 interconnecting the air cartridge 60 and the object 70 allows high-pressure air in the air cartridge 60 to flow through the first space 413, the channel 416, and the second space 415 and includes the safe device 43 moved to an operating position that allows the high-pressure air into the object 70. Also, the high-pressure air will not flow into the chamber 203 because the first and second spaces 413 and 415, the channel 416, and the inlet and outlet ends 401 and 402 are not in fluidal communication with the chamber 203.

The second nozzle head assembly 50 is engaged with the first cylinder 21 and in fluidal communication with the chamber 203 and defines a valve-receiving end 501 including the object 70 engagable therewith, with the object 70 disposed adjacent to the first proximal end 211 of the first cylinder 21. The second nozzle head assembly 50 includes a valve connector 51, a valve pusher 52, a seat 53, and a hose 54. The valve-receiving end 501 is defined in the valve connector 51. The cylinder assembly 20 defines a first engaging section 214 and the valve connector 51 defines a second engaging section 512 respectively. The valve connector 51 includes a seal ring 511 disposed therein and adapted to prevent air leak between the valve connector 51 and the object 70. The valve pusher 52 interconnects the valve connector 51 and the hose 54 and is movable relative to the valve connector 51 linearly. The hose 54 is made of pliable material and has an end engaged with the seat 53. The seat 53 is movably restrained in the chamber 203 and includes a passage 531 extended therethrough. The chamber 203, the seat 53, the hose 54, the valve pusher 52, and the valve connector 51 are in fluidal communication with each other. The second nozzle head assembly 50 is movable in a collapsed position in which the valve connector 51, the valve pusher 52, and the hose 54 are received in the cylinder assembly 20 and the valve connector 51 includes the second engaging section 512 engaged with the first engaging section 214 of the cylinder assembly 20, and an extended position in which the valve connector 51, the valve pusher 52, and the hose 54 are disposed outside the cylinder assembly 20 and the valve connector 51 includes the second engaging section 512 disengaged from the first engaging section 214 of the cylinder assembly 20. The second nozzle head assembly 50 moved to the collapsed position includes the first and second engaging sections 214 and 512 in thread engagement. Further, a second cap 55 is utilized to selectively close a port of the valve-receiving end 501. Further, a check valve 24 that allows the external air in the chamber 203 to pass in a direction towards the second nozzle head assembly 50 and not to flow reversely is disposed in the chamber 203 and between the piston 23 and the second nozzle head assembly 50.

Additionally, the air cartridge 60 engaged with the first nozzle head assembly 40 can be utilized as a grip, which is adapted to be grasped by a user to operably move the pump 10 for inflating the object 70.

Figure 6:
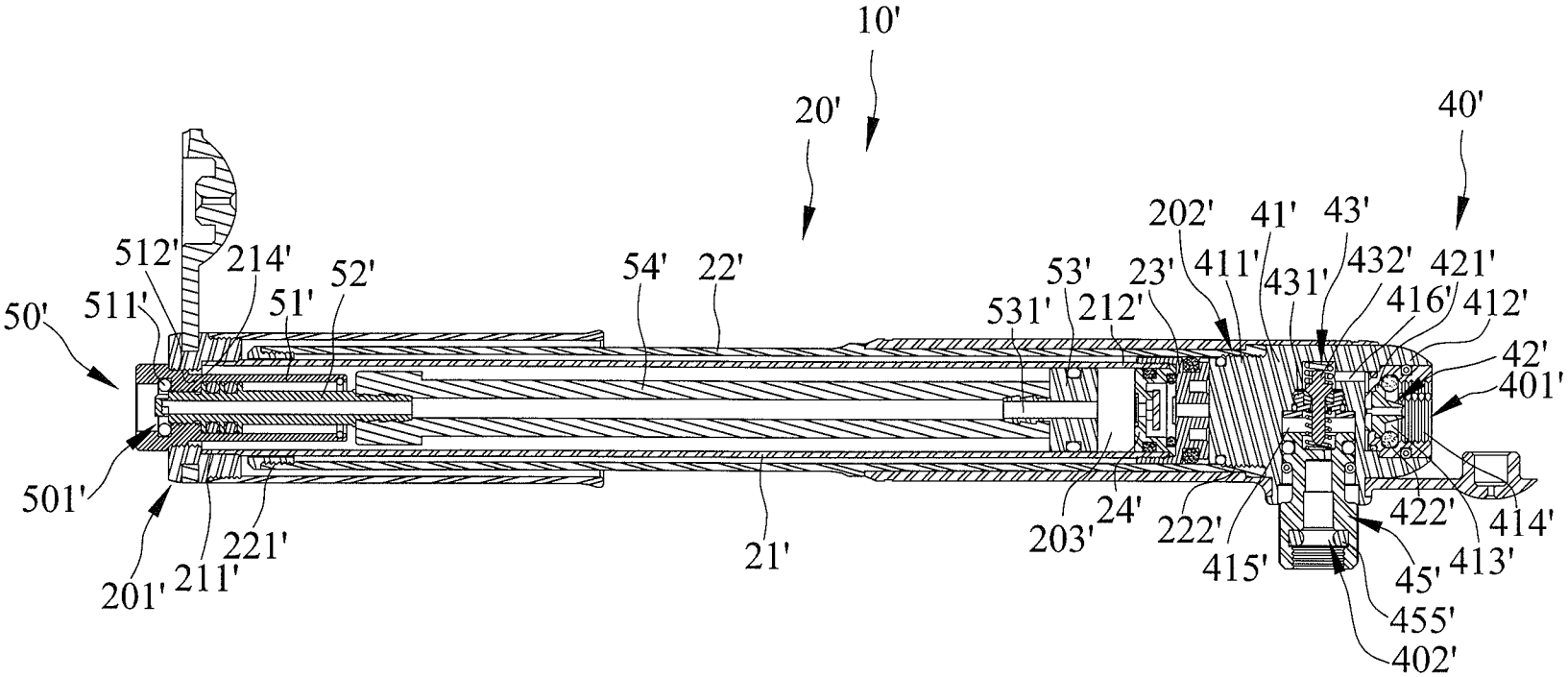
FIG. 6 is a cross-sectional view of a pump which is adapted to be operably moved or to use a high-pressure air cartridge to inflate an object in accordance with a second embodiment of the present invention.
Figure 7:
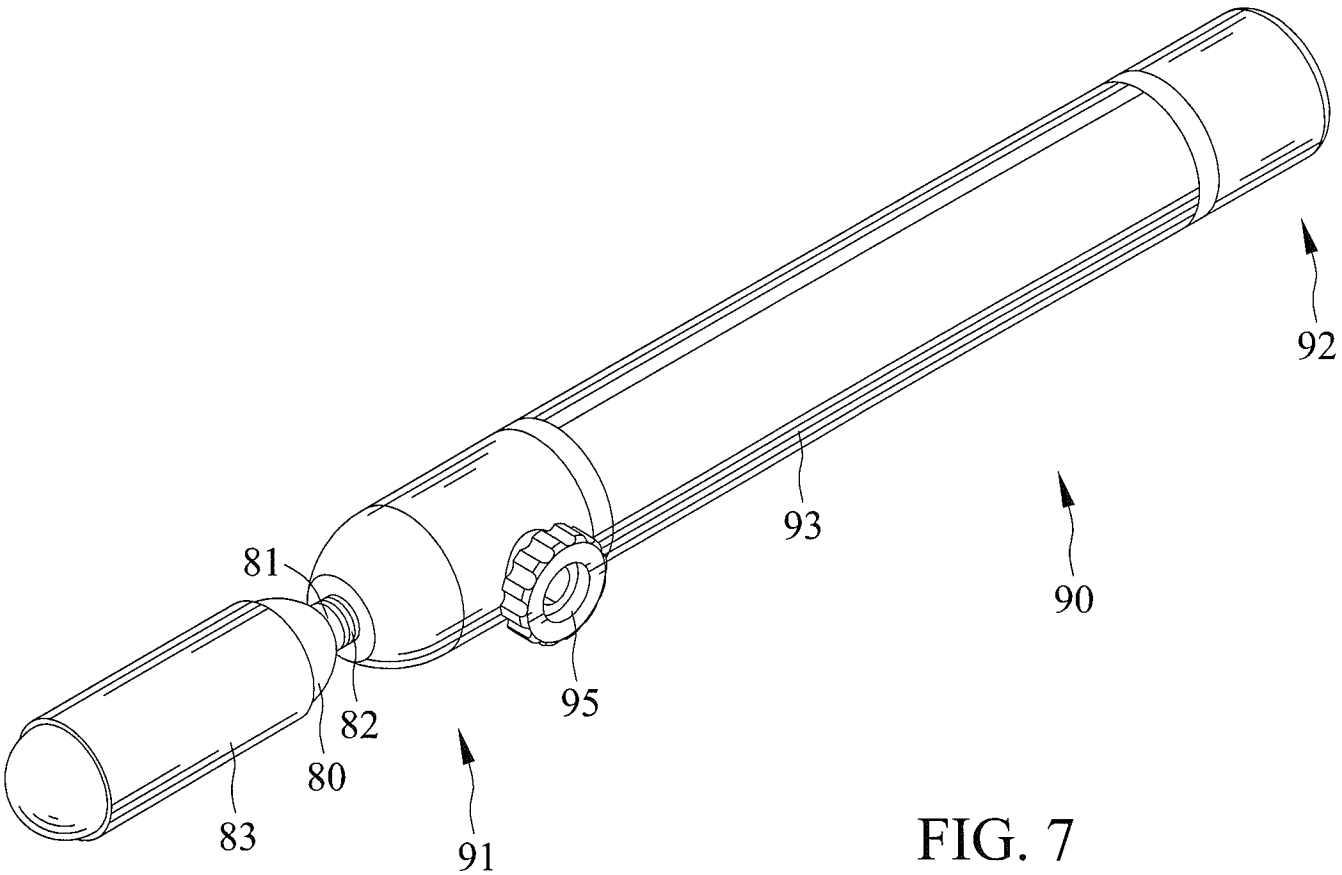
FIG. 7 PRIOR ART
FIG. 7 is a perspective view of a conventional pump, with the conventional pump including first and second ends engagable with an air cartridge, with the air cartridge engaged at the first end of the pump.
Figure 8:
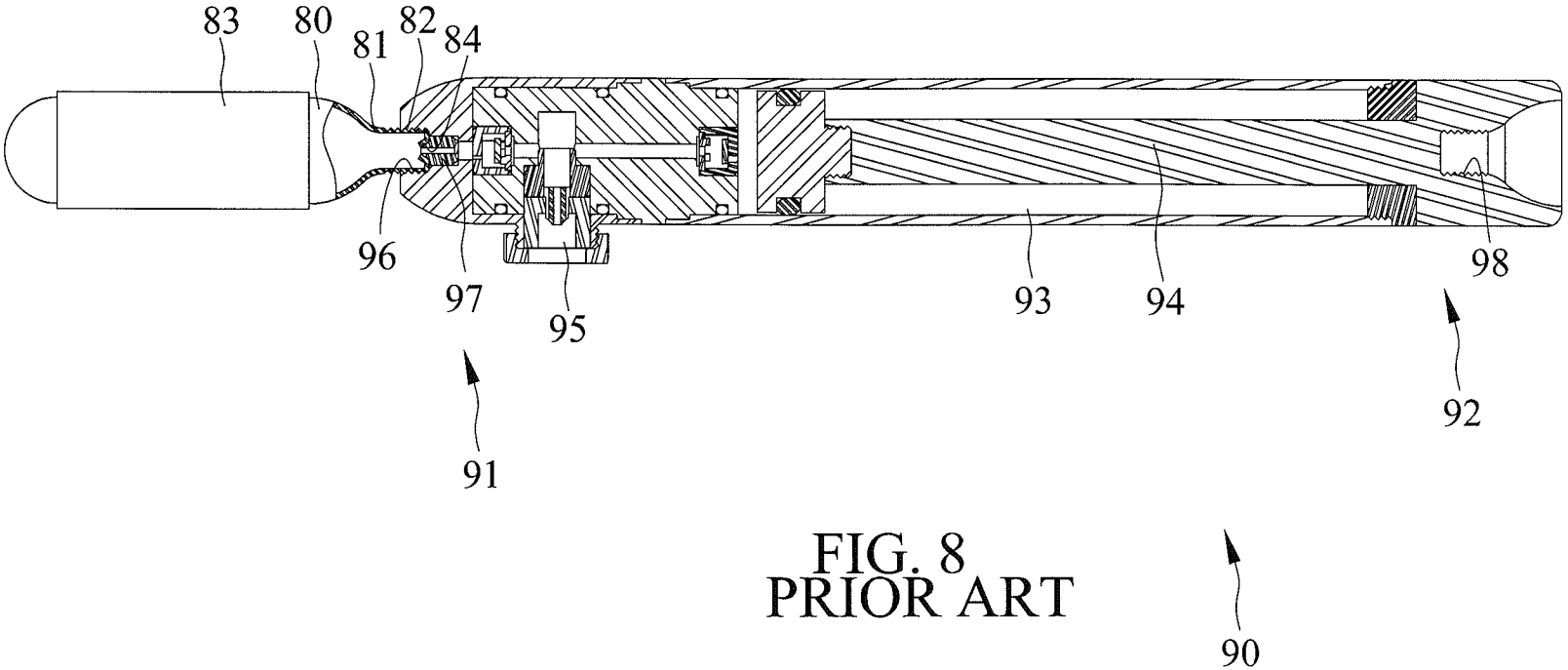
FIG. 8 PRIOR ART
FIG. 8 is a cross-sectional view of the conventional pump of FIG. 6.
Figure 9:
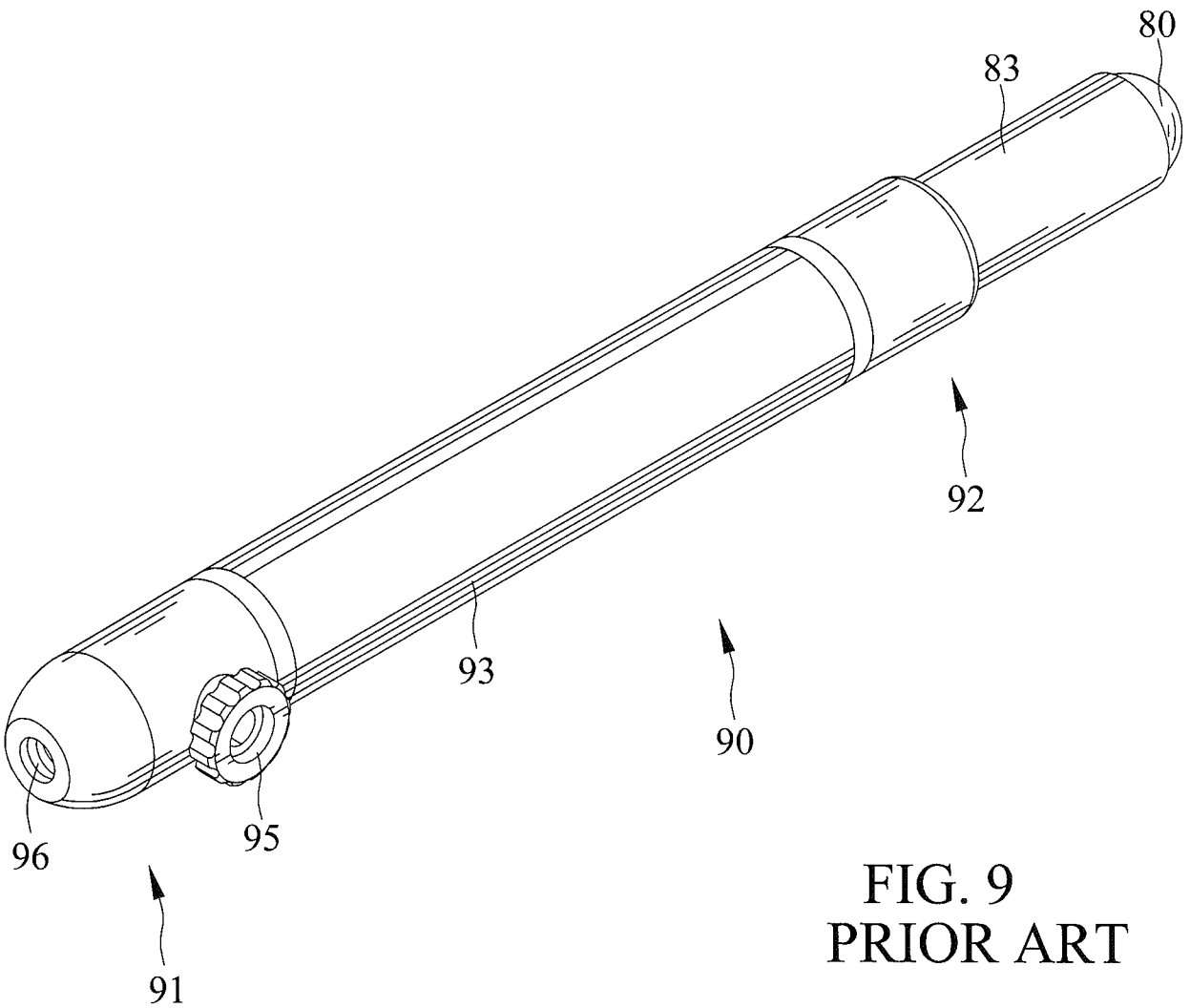
FIG. 9 PRIOR ART
FIG. 9 is a perspective view of the convention pump, with the air cartridge engaged at the second end of the pump.

FIG. 6 shows a pump 10' which is adapted to be operably moved or to use the high-pressure air cartridge 60 to inflate the object in accordance with a second embodiment of the present invention. The second embodiment uses the same numbers as the first embodiment to indicate the same components, except bearing a prime. The second embodiment is substantially the same as the first embodiment, however, the first embodiment includes the inlet and outlet ends 401 and 402 defined on opposite ends so the air cartridge 60 engaged with the inlet end 401 and the object 70 engaged with the outlet end 402 are disposed opposite to each other and such that the air cartridge 60 and the object 70 are disposed on the lateral sides of the pump 10, whereas the second embodiment includes an inlet end 401' and an outlet end 402' defined on non-opposite ends, preferably, the inlet end 401' faces a first direction and the outlet end 402' faces a second direction orthogonal to the first direction, so the air cartridge 60 engaged with the inlet end 401' and the object engaged with the outlet end 402' are disposed orthogonal to each other and such that the air cartridge 60 is disposed on an end of the cylinder assembly 20' of the pump 10' and the object 70 is disposed on the lateral side of the pump 10'.

In view of the forgoing, the present invention is to provide the pump 10 and 10' adapted to be operably moved or to use the high-pressure air cartridge 60 to inflate the object 70, and to provide the pump 10 and 10' including the first nozzle head assembly 40 and 40' and the second nozzle head assembly 50 and 50', with the first nozzle head assembly 40 and 40' including the inlet end 401 and 401' including the air cartridge 60 engagable therewith and the outlet end 402 and 402' including the object 70 engagable therewith, with the second nozzle head assembly 50 and 50' including the object 70 engagable therewith, with the object 70 engaged with the second nozzle head assembly 50 and 50' when the pump 10 and 10' is operably moved to inflate the object 70, and also to allow the aforementioned components disposed in the interior of the pump 10 and 10' to be safeguarded from being damaged by the high-pressure air. Additionally, the first nozzle head assembly 40 and 40' adapted to be used independently.

While the specific embodiments have been illustrated and described, numerous modifications come to mind without significantly departing from the spirit of invention and the scope of invention is only limited by the scope of accompanying claims.

What is claimed is:

1. A pump which is adapted to be operably moved or to use a high-pressure air cartridge to inflate an object comprising:

a cylinder assembly defining a chamber and including first and second cylinders surrounding the chamber, with the second cylinder movable relative to the first cylinder linearly, with the first cylinder connected to a piston, the piston disposed between the first and second cylinders, with the piston operably moved to induce external air in and out of the chamber, with the first cylinder defining a first proximal end and a first distal end opposite to the first proximal end and the second cylinder defining a second proximal end and a second distal end opposite to the second proximal end respectively;

a first nozzle head assembly detachably engaged with the second distal end of the second cylinder and including a main body, a valve stem kit, a safe device, and a joint, with the main body including an inlet end opposite an outlet end and defining a fixing end and a free end, with the inlet end including an air cartridge engagable therewith, with the outlet end including an object engagable therewith, with the free end including a first space and a second space, with the first space in fluid communication with the inlet end and the second space in fluid communication with the outlet end respectively, with the first and second spaces including a channel extended therebetween so as to be interconnected, with the valve stem kit including a valve stem for causing a closure of the air cartridge to open and a seal ring for preventing air leak, with the valve stem and the seal ring disposed within the joint, with the joint received in the first space, with the safe device disposed in the second space, with the first nozzle head assembly interconnecting the air cartridge and the object allowing high-pressure air in the air cartridge to flow through the first space, the channel, and the second space and including the safe device moved to an operating position that allows the high-pressure air into the object, with the first and second spaces, the channel, and the inlet and outlet ends never in fluid communication with the chamber, with the joint used for engaging with the air cartridge, with the inlet end defined in the joint; and a second nozzle head assembly engaged with the first cylinder and adjacent to the first proximal end of the first cylinder and in fluid communication with the chamber and defining a valve-receiving end adaptable to engage with the object.

2. The pump as claimed in claim 1, wherein the cylinder assembly defines a first engaging section, wherein the second nozzle head assembly includes a valve connector, a valve pusher, a seat, and a hose, with the valve-receiving end defined in the valve connector, with the valve connector defining a second engaging section, with the valve pusher interconnecting the valve connector and the hose and movable relative to the valve connector linearly, with the hose made of pliable material and having an end engaged with the seat, with the seat movably restrained in the chamber and including a passage extended therethrough, with the chamber, the seat, the hose, the valve pusher, and the valve connector in fluid communication with each other, with the second nozzle head assembly movable from a retracted position in which the valve connector, the valve pusher, and the hose are received in the cylinder assembly and the valve connector includes the second engaging section engaged with the first engaging section of the cylinder assembly, into an extended position in which the valve connector, the valve pusher, and the hose are disposed outside the cylinder assembly and the valve connector includes the second engaging section disengaged from the first engaging section of the cylinder assembly.

3. The pump as claimed in claim 1, wherein the joint is made of metal, with the joint releasably disposed in the first space, with the first nozzle head assembly adapted to be reinforced by the joint, with the joint including an orifice, with the orifice extended through the joint and including the valve stem kit received therein.

4. The pump as claimed in claim 3, wherein the main body includes a first wall delimiting the first space and including at least one first hole extended therethrough and transversely to the first space, with the joint including at least one slot, with the joint having an outer periphery including the at least one slot inset therein, with at least one fastener inserted in the at least one first hole and received in the at least one slot so that the joint is securely restrained in the first space.

5. The pump as claimed in claim 1, wherein the safe device interacts with a valve receiver, with the valve receiver releasably and movably disposed in the second space and including the object engagable therewith, with the safe device including a valve socket, a plunger, and a first biasing member, with the valve socket including a cavity extended therethrough and including the plunger and the first biasing member disposed therein, with the plunger biasingly engaged with the first biasing member and movable relative to the valve socket in a first position preventing air flowing from the first space to the second space and a second position allowing air to flow from the first space to the second space, with the valve receiver movable to a position pushing the plunger.

6. The pump as claimed in claim 5, wherein the valve receiver defines a first joining end and a second joining end opposite to the first joining end, with the first joining end received in the second space and abutted against a second biasing member, with the second biasing member abutted against the valve socket that is disposed opposite to the valve receiver, with the outlet end of the first nozzle head assembly defined in the second joining end.

7. The pump as claimed in claim 4, wherein the first nozzle head assembly includes a second wall delimiting the second space and including at least one second hole extended therethrough and transversely to the second space, with the valve receiver having an outer periphery defining a recessed section, with the recessed section not abutted against the second wall, with the valve receiver including at least one fixing member inserted in the at least one second hole and received between two distal ends of the recessed section so that the joint is movably and securely restrained in the second space.

8. The pump as claimed in claim 5, wherein the first nozzle head assembly includes a second wall delimiting the second space and including at least one second hole extended therethrough and transversely to the second space, with the valve receiver having an outer periphery defining a recessed section, with the recessed section not abutted against the second wall, with the valve receiver including at least one fixing member inserted in the at least one second hole and received between two distal ends of the recessed section so that the joint is movably and securely restrained in the second space.

9. The pump as claimed in claim 6, wherein the first nozzle head assembly includes a second wall delimiting the second space and including at least one second hole extended therethrough and transversely to the second space, with the valve receiver having an outer periphery defining a recessed section, with the recessed section not abutted against the second wall, with the valve receiver including at least one fixing member inserted in the at least one second hole and received between two distal ends of the recessed section so that the joint is movably and securely restrained in the second space.

* * * * *